US006937834B2

(12) United States Patent
Kanno et al.

(10) Patent No.: US 6,937,834 B2
(45) Date of Patent: Aug. 30, 2005

(54) SPACING MEMBER, PROCESS CARTRIDGE, AND ELECTROPHOTOGRAPHIC IMAGE FORMING APPARATUS

(75) Inventors: Kazuhiko Kanno, Kanagawa (JP); Shinjiro Toba, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/671,696

(22) Filed: Sep. 29, 2003

(65) Prior Publication Data

US 2004/0126135 A1 Jul. 1, 2004

(30) Foreign Application Priority Data

Sep. 30, 2002 (JP) ..... 2002-286915

(51) Int. Cl.[7] ..... G03G 21/18
(52) U.S. Cl. ..... 399/114; 399/111
(58) Field of Search ..... 399/107, 110, 399/111, 113, 114

(56) References Cited

U.S. PATENT DOCUMENTS

| | | | | |
|---|---|---|---|---|
| 5,729,796 | A | 3/1998 | Miura et al. | 399/114 |
| 5,768,658 | A | 6/1998 | Watanabe et al. | 399/111 |
| 5,815,644 | A | 9/1998 | Nishiuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,926,666 | A | 7/1999 | Miura et al. | 399/25 |
| 5,937,240 | A | 8/1999 | Kanno et al. | 399/111 |
| 5,940,657 | A | 8/1999 | Yokomori et al. | 399/119 |
| 5,950,049 | A | 9/1999 | Yokomori et al. | 399/119 |
| 6,070,029 | A | 5/2000 | Nishiuwatoko et al. | 399/111 |
| 6,072,969 | A | 6/2000 | Yokomori et al. | 399/119 |
| 6,345,164 | B1 | 2/2002 | Yokomori et al. | 399/119 |
| 6,381,430 | B1 | 4/2002 | Yokomori et al. | 399/119 |
| 6,424,811 | B1 | 7/2002 | Tsuda et al. | 399/167 |
| 6,496,667 | B2 | 12/2002 | Shiratori et al. | 399/103 |
| 6,516,168 | B2 | 2/2003 | Shiratori et al. | 399/103 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,560,422 | B2 | 5/2003 | Kanno et al. | 399/106 |
| 6,603,939 | B1 | 8/2003 | Toba et al. | 399/103 |
| 6,690,897 | B2 * | 2/2004 | Takami | 399/50 |
| 2002/0031368 | A1 | 3/2002 | Kanno et al. | 399/103 |
| 2002/0076236 | A1 | 6/2002 | Toba et al. | 399/111 |
| 2002/0110386 | A1 | 8/2002 | Kanno et al. | 399/228 |
| 2003/0086723 | A1 | 5/2003 | Yamaguchi et al. | 399/119 |

FOREIGN PATENT DOCUMENTS

| | | |
|---|---|---|
| JP | 2-39169 | 2/1990 |
| JP | 6-316349 | 11/1994 |
| JP | 10-177329 | 6/1998 |
| JP | 11-30944 | 2/1999 |

* cited by examiner

*Primary Examiner*—Hoan Tran
(74) *Attorney, Agent, or Firm*—Fitzpatrick, Cella, Harper & Scinto

(57) ABSTRACT

The spacing member includes: a spacing portion for spacing an electrophotographic photosensitive drum and a charging roller when the spacing member is attached to the process cartridge; a stopper portion for preventing a shutter member from retracting from a protection position for covering an exposure portion, when the spacing member is attached to the process cartridge; and a protective portion for covering a positioning portion, which positions the process cartridge in an apparatus body when the process cartridge is mounted in the apparatus body, when the spacing member is attached to the process cartridge. Thus, it is possible to reliably keep the spaced state between the photosensitive drum and the charging roller.

13 Claims, 10 Drawing Sheets

SPACING MEMBER, PROCESS CARTRIDGE, AND ELECTROPHOTOGRAPHIC IMAGE FORMING APPARATUS

BACKGROUND OF THE INVENTION

1. Field of the Invention

The present invention relates to a spacing member to be attached to a process cartridge, a process cartridge, and an electrophotographic image forming apparatus which process cartridge is capable of being mounted in and demounted from the electrophotographic image forming apparatus.

Here, the electrophotographic image forming apparatus involves an electrophotographic copying machine, an electrophotographic printer (e.g., an LED printer or a laser beam printer), an electrophotographic facsimile apparatus, an electrophotographic word processor and so on.

On the other hand, the process cartridge is constructed by integrating an electrophotographic photosensitive member with at least one process means to act on the electrophotographic photosensitive member into a cartridge so that the cartridge may be mounted in and demounted from the main body of the image forming apparatus.

2. Description of the Related Art

In the electrophotographic image forming apparatus using the electrophotographic image forming process, an image is formed by transferring a developer image formed on a photosensitive drum to the recording medium. In the color image forming apparatus, on the other hand, the developer images of individual colors, as formed sequentially on the photosensitive drum, are transferred in a superposed manner to an intermediate transfer member. And, the color images are transferred altogether to the recording medium. In this case, in order that the portions of the photosensitive drum or the like to be degraded or consumed may be easily handled, there is widely used a process cartridge system, in which those portions are united so that they may be mounted in and demounted from the main body of the image forming apparatus.

One conventional example of the color image forming apparatus using an intermediate transfer member is shown in FIG. 10. In this image forming apparatus (as will be called the "conventional apparatus A"), a photosensitive member unit 350 and an intermediate transfer unit 351 are constructed as independent cartridges. And, a movable side frame 352 is opened by turning it toward the front face of the apparatus. And, the photosensitive member unit 350 and the intermediate transfer unit 351 are individually inserted downward and mounted in the apparatus body.

As another conventional example of the color image forming apparatus using the intermediate transfer member, on the other hand, there is known (in JP-A-11-30944 or JP-A-10-177329) an apparatus (as will be called the "conventional apparatus B"), in which a photosensitive member belt, an intermediate transfer belt and a box for accumulating removed developers are integrally constructed.

In the conventional apparatus B, the photosensitive member belt and the removed developer accumulating box are arranged on the projected lower face of the intermediate transfer belt. As in the conventional apparatus A, moreover, the movable frame is turned and opened toward the front face of the apparatus, and a process cartridge, in which the intermediate transfer member, the photosensitive member and the removed developer accumulating box are integrated, is inserted downward.

As the method for charging the photosensitive drum surface, here is known a contact charge device, in which the charging act is done by bringing a charging roller into contact with the photosensitive drum surface.

The contact charge device has to be disposed in reliable contact with the photosensitive drum surface. For this necessity, the charging roller is pushed to contact with the photosensitive drum by a predetermined pressure.

Therefore, the charging roller is deformed at only one portion if it is stored without any action for a long time. In this case, a deformation may be caused by the creep phenomenon of rubber.

Therefore, the spacer member is sandwiched between the core of the charging roller and the photosensitive drum thereby to space the charging roller from the photosensitive drum. There is known a construction (e.g., JP-A-2-39169), in which the spacing prevents the rubber surface layer of the charging roller from being deformed. Alternatively, there is also known a method (e.g., JP-A-6-316349), in which the pressure and the spacing are caused by using a solenoid.

However, the following problems are accompanied by the prior art thus far described.

With the construction in which the spacer member is sandwiched between the core of the charging roller and the photosensitive drum to space the charging roller from the photosensitive drum, the operator may mount the cartridge in the image forming apparatus without removing the spacer member.

Moreover, the construction for causing the pressure and the spacing by using the solenoid complicates the construction of the image forming apparatus thereby to raise the cost.

SUMMARY OF THE INVENTION

The invention has been conceived to solve the aforementioned problems of the prior art.

An object of the invention is to provide a spacing member capable of reliably keeping the spacing between an electrophotographic photosensitive drum and a charging roller, a process cartridge using the spacing member, and an electrophotographic image forming apparatus.

Another object of the invention is to provide a spacing member spacing the electrophotographic photosensitive drum and the charging roller and capable of preventing the process cartridge from being mounted in the main body of the electrophotographic image forming apparatus while being attached to the process cartridge, when the process cartridge is to be mounted in the electrophotographic image forming apparatus, a process cartridge using the spacing member, and an electrophotographic image forming apparatus.

Still another object of the invention is to provide a spacing member capable of spacing the electrophotographic photosensitive drum and the charging roller and preventing a shutter for protecting the electrophotographic photosensitive drum from moving from a protecting position to a retracted position, a process cartridge using the spacing member, and an electrophotographic image forming apparatus.

A further object is to provide a spacing member, a process cartridge and an electrophotographic image forming apparatus, which can keep a photosensitive drum and a charging roller spaced from each other and can prevent a shutter from being opened and can prevent a process cartridge from being mounted by an operator in the main body of the image forming apparatus without detaching the spacing member when the process cartridge is to be mounted in the main body of the apparatus.

DETAILED DESCRIPTION OF THE PREFERRED EMBODIMENTS

With reference to the accompanying drawings, here will be described the preferred embodiments of the invention. However, the sizes, materials, shapes, relative arrangements and so on of components described in the embodiments are not intended to restrict the scope of the invention thereto, unless they are specifically described so. Moreover, the materials, shapes and so on of the members, which are once described in the following description, are similar to those of the first description so long as they are not newly described so.

Here in the following description, the phrase "front face of the apparatus" means the face on the upstream side (i.e., on the righthand side of FIG. 2) of conveyance of a recording medium from a transfer process to a fixing process. Moreover, the phrase "lefthand and righthand sides with respect to the main body of the apparatus and the process cartridge" means the lefthand and righthand sides, as viewed from the apparatus front face.

(First Embodiment)

(Entire Construction of Image Forming Apparatus)

First of all, the entire construction and the operations of a color electrophotographic image forming apparatus capable of suitably using the process cartridge according to one embodiment of the invention will be described with reference to FIG. 2.

Figure 2:
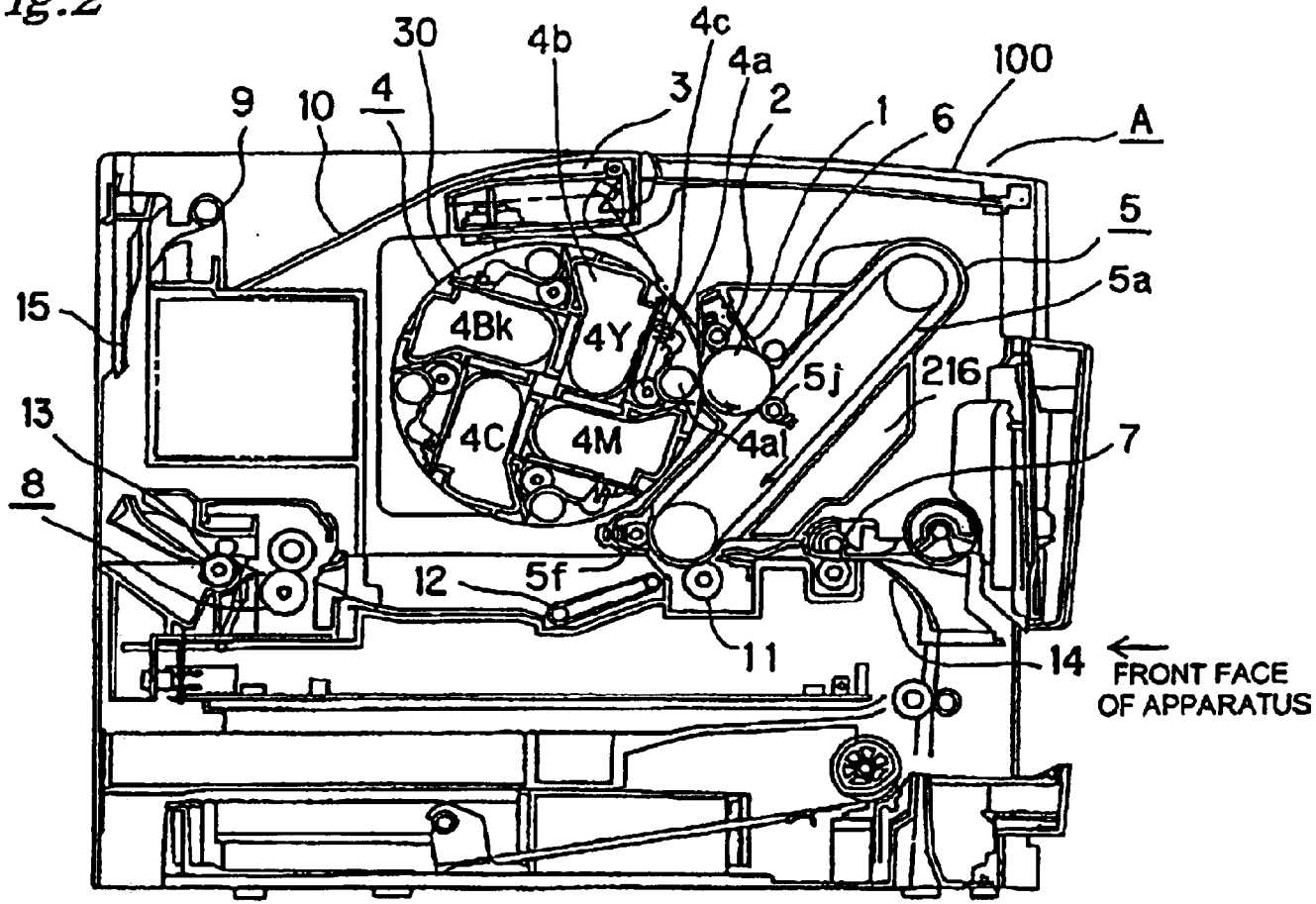
FIG. 2 is a longitudinal section of an electrophotographic image forming apparatus according to this embodiment.

FIG. 2 is a longitudinal section showing a schematic construction of one mode of the image forming apparatus according to the invention, that is, a color electrophotographic laser beam printer, in which a developing cartridge 4 and a process cartridge 5 having a photosensitive drum are mounted in the body of the image forming apparatus.

The photosensitive drum 1 rotates in the (counterclockwise) direction of arrow of FIG. 2 in synchronism with the rotation of an intermediate transfer belt 5*a*. A charging device 2 charges the surface of the photosensitive drum 1 uniformly. Exposure means 3 irradiates the surface of the charged photosensitive drum 1 with an image beam based on each color information such as Yellow image information, to form an electrostatic latent image corresponding to the Yellow image on the photosensitive drum 1.

The developing device 4 is driven to rotate simultaneously as the electrostatic latent image is formed, to move a developing cartridge 4Y of the yellow color to a developing position. A developing roller acting as process means develops the electrostatic latent image formed on the photosensitive drum 1, by applying yellow toner thereto.

After this, a bias voltage having the reversed polarity of the toner is applied to a holding roller (or a primary transfer roller) 5*j*, which is arranged to confront the photosensitive drum 1 across the transfer belt 5*a*. As a result, the yellow toner image on the photosensitive drum 1 is primarily transferred to the transfer belt 5*a*.

When the primary transfer of the yellow toner image was thus ended, a next developer cartridge (4M) of the developing device 4 is rotationally moved to the developing position confronting the photosensitive drum 1. The foregoing steps of forming, developing the electrostatic latent image and primarily transferring are sequentially repeated for the individual colors of Magenta (M), Cyan (C) and Black (Bk). As a result, the four color toner images are superposed on the intermediate transfer belt 5*a*.

In this meanwhile, a transfer roller 11 is located at a position out of contact with the transfer belt 5*a*. And, a cleaning charge roller 5*f* acting as a cleaning unit is also located at a position out of contact with the intermediate transfer belt 5*a*.

After the four toner images were formed on the transfer belt 5*a*, the transfer roller 11 is pushed onto the transfer belt 5*a*, as shown in FIG. 2. In synchronism with the rotation of the transfer belt 5*a*, moreover, the recording medium standing by at a predetermined position near a resist roller pair 7 acting as feed means is sent to a nipping portion between the transfer belt 5*a* and the transfer roller 11.

Just upstream of the resist roller pair 7, there is disposed a pre-resist sensor 14 for detecting the leading end of the recording medium so that it may block the transmission of the rotational driving force to the roller pair 7 thereby to cause the recording medium to stand by at the predetermined position.

To the transfer roller 11, there is applied a bias voltage of the reversed polarity of the toner. The toner images on the transfer belt 5*a* are secondarily transferred as a whole to the surface of the recording medium conveyed.

The recording medium thus having the toner images secondarily transferred thereto is conveyed to a fixing device 8 through a conveyor belt unit 12. And, the toner images of plurality colors are fixed by the fixing device 8.

The recording medium having the toners fixed thereon is conveyed along a sheet discharge guide 15 by a discharge roller pair 13. And, the recording medium is discharged to a feeder tray 10 in the upper portion of the color image forming apparatus A by a discharge roller pair 9. As a result, the image formation is completed.

On the other hand, the cleaning charge roller 5*f* is pushed after the secondary transfer to the transfer belt 5*a* thereby to apply the reversed charge of that of the transferring time to the residual toners left on the transfer belt 5*a*.

The residual toners of the reversed charge are electrostatically caught by the photosensitive drum 1 and are then recovered by a cleaning blade 6 for the photosensitive drum. The residual toners recovered are conveyed as the waste toners along the later-described conveyor path. And, the residual toners conveyed are recovered in a waste toner box 216.

(Construction of Developing Cartridge)

With reference to FIG. 2, here will be described the construction of the developing cartridge.

The developing cartridges 4 (4Bk, 4M, 4C and 4Y) containing the toners of the individual colors black, magenta, yellow, and cyan are fixed at predetermined positions in a developing rotary unit 30. This rotary unit 30 rotates on its center pin, and this center pin is provided on its two sides with not-shown circular rotary flanges, on which the developing cartridges 4 are removably fixed.

By this fixed arrangement, the developing cartridge 4 does not come out of the rotary unit 30 even when this rotary unit 30 rotates. The developing cartridge 4 is pulled out with a not-shown grip, when it is to be extracted to the outside of a main body 100 of an apparatus. The developing cartridge 4 is retained on the two flanges of the rotary unit 30 by means of torsional coil springs. As a result, the developing cartridge 4 can be attached to/detached from the rotary unit 30 by the operation of the operator.

The developing cartridge body is coarsely divided into a developing portion 4*a* and a toner containing portion 4*b*. This toner containing portion 4*b* is filled with a toner of a predetermined color. And, agitating means rotates to convey the toner to the developing portion 4*a*. The toner conveyed is fed in the developing portion 4*a* to a developing roller 4*a*1 by the rotation of a spongy toner feed roller 4*c*. Moreover, the toner is electrically charged into a thin layer by the friction between developing blades of a thin sheet shape and the developing roller 4*a*1.

The thinned toner on the developing roller 4*a*1 is conveyed to the developing portion by the rotation of the developing roller 4*a*1. And, a predetermined developing bias is applied to the developing roller 4*a*1. As a result, the electrostatic latent image formed on the photosensitive drum 1 is visualized as the toner image.

The residual toner having failed to contribute to the visualization of the latent image on the photosensitive drum 1, that is, the undeveloped toner on the surface of the developing roller 4*a*1 is scraped away again at the toner feed roller 4*c*. Simultaneously with this, the fresh toner is fed onto the developing roller 4*a*1 so that a new developing action is continuously done.

(Process Cartridge Having Photosensitive Drum and Intermediate Transfer Member Integrated)

Figure 3:
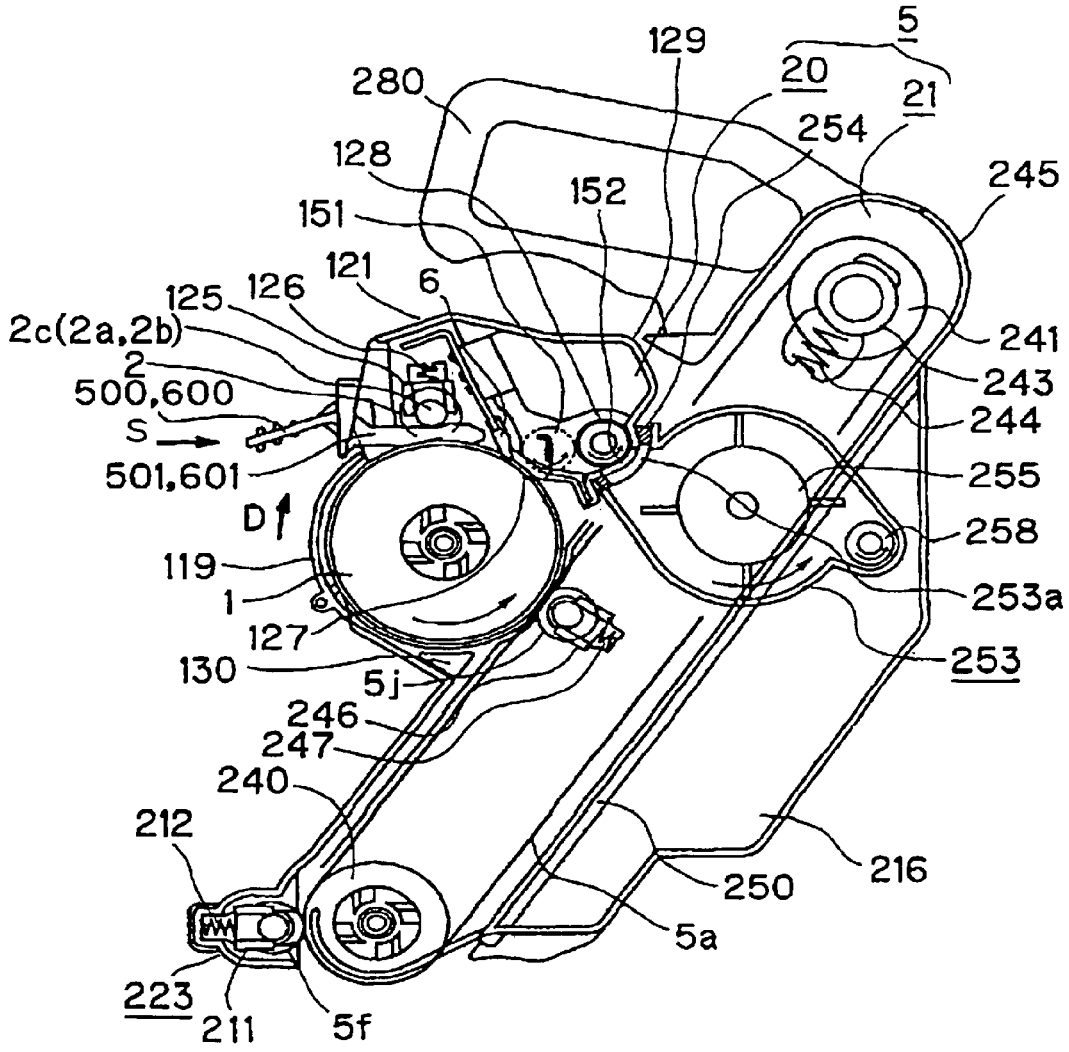
FIG. 3 is a longitudinal section of a process cartridge according to this embodiment and taken from the lefthand side face with respect to the front face of the apparatus.

With reference to FIG. 3, here will be described the construction of the process cartridge, which has the photosensitive member unit and the intermediate transfer unit integrated. FIG. 3 is a longitudinal section of the process cartridge according to this embodiment and taken from the lefthand side face with respect to the front face of the apparatus.

In the process cartridge 5, as shown in FIG. 3, a photosensitive member unit 20 is arranged on the protruding upper face of an intermediate transfer unit 21. On the lefthand side face, as viewed from the apparatus front face, of the photosensitive member unit 20, moreover, there is arranged the waste toner box portion 216 of an integral construction.

On the other hand, a belt drive roller 240 of the unit 21 is integrally provided with a cleaning charge roller unit 223 for applying the reversed charge of the transfer time to the residual toner on the transfer belt 5*a*.

Figure 4:
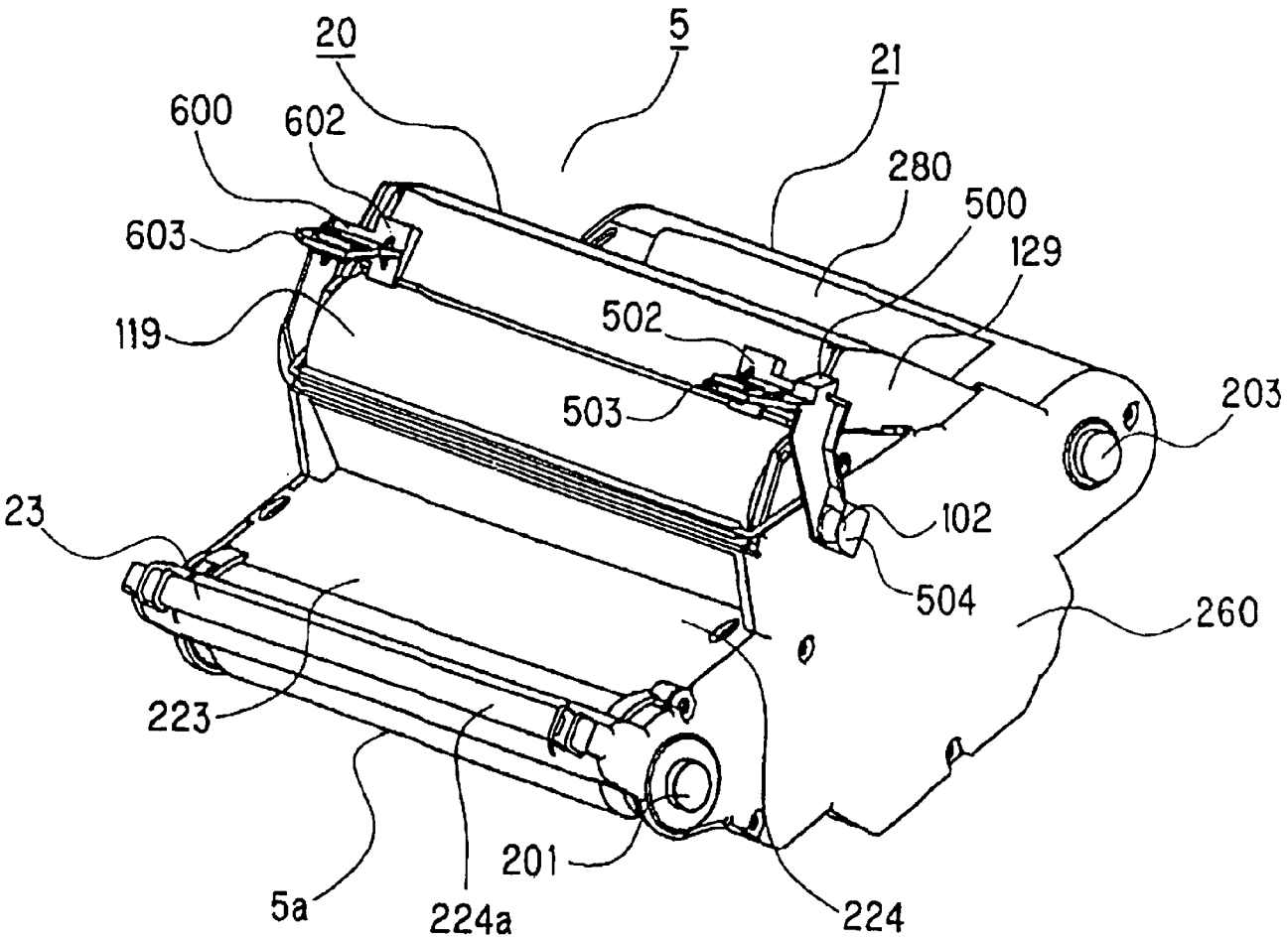
FIG. 4 is a perspective view of the process cartridge according to this embodiment and taken from the lefthand side.
Figure 5:
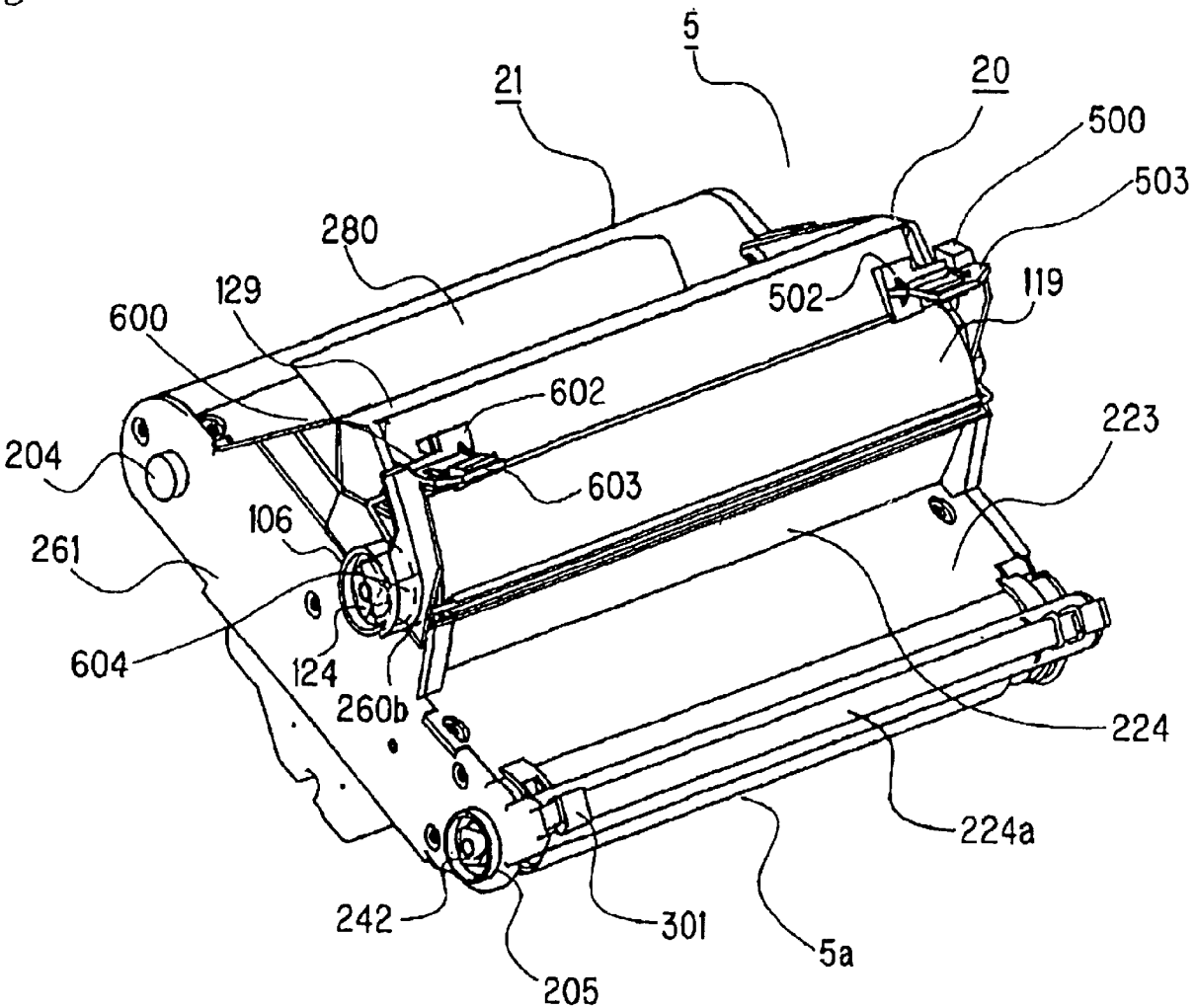
FIG. 5 is a perspective view of the process cartridge according to this embodiment and taken from the righthand side.

In the unit 20, the photosensitive drum 1 is rotatably mounted in a photosensitive member frame 129 such that it is held on its two ends by a lefthand bearing 102 (as referred to FIG. 4) and a righthand bearing 106 (as referred to FIG. 5). And, a predetermined rotational drive force is transmitted to the main body 100 through a coupling 124 (as referred to FIG. 5) in the righthand end portion.

As shown in FIG. 3, moreover, the charging roller 2 is pushed onto the photosensitive drum 1 through bearings 125 at the two ends by a predetermined force of compression springs 126. As a result, the charging roller 2 rotates while following the photosensitive drum 1. At least one bearing 125 is constructed of a conductive member. Through the bearings 125, therefore, a predetermined charging bias is applied to the charging roller 2 acting as process means. As a result, the photosensitive drum 1 is charged uniformly over its surface.

Moreover, the photosensitive drum 1 is provided at its predetermined position with the cleaning blade 6. After transferring the toner images on the photosensitive drum 1 primarily onto the transfer belt 5*a*, the cleaning blade 6 scrapes away the residual toner which is left on the photosensitive drum 1. Moreover, the residual toners (i.e., the residual toners left on the transfer belt 5*a* after the secondarily transfer) on the transfer belt 5*a* given the aforementioned reversed charge are recovered onto the photosensitive drum 1 and are scraped away together with the residual toners left on the photosensitive drum 1 after the primary transfer.

The waste toners which are scraped by the cleaning blade 6 are prevented by a scoop sheet 127 from falling onto the transfer belt 5*a*. The waste toners accumulated on the bottom portion of the photosensitive member frame 129 are conveyed to the lefthand side, as viewed from the front face of the apparatus, by the rotation of a conveyor screw 128.

After this, the waste toners are conveyed by the conveyor screw 128 to the lefthand side face (as viewed from the front face of the apparatus) of the unit 20. And, the waste toners are accumulated in the waste toner box 216, which is disposed on the opposite side of the unit 20 with respect to the transfer belt 5*a*.

The box 216 is constructed by welding a partition panel 250 to an intermediate transfer frame 245. And, the residual toners on the photosensitive drum 1 are finally contained in that box 216.

To the lefthand side of the frame 245, there is jointed a vane wheel cover 253 through a seal member. This cover 253 is provided in its upper side with an opening 253*a*, at which it is jointed through a seal member 254 to an opening 152 formed in the lefthand end lower portion of the photosensitive member frame 129. And, the waste toners having dropped from the opening 152 enter the inside of the cover 253.

Inside of the cover 253, a vane wheel 255 rotates counterclockwise, as viewed from the lefthand side face, to convey the inside waste toners toward the box 216. The cover 253 overlaps the lefthand side face of the box 216. And, a hole leading to the inside of the cover 253 is formed in that overlapping portion.

At a position extending longitudinally from that hole, moreover, there is disposed a second screw 258. And, the waste toners conveyed by the vane wheel 255 are further conveyed from the lefthand side deeply to the righthand side of the box 216 by rotating the screw 258.

The box 216 is divided into several small compartments by a plurality of partitions perpendicular to the axis of the screw 258. And, these small compartments are filled sequentially from the lefthand end one to the adjoining righthand one. Moreover, the righthand end small compartment is provided with a not-shown detecting unit for detecting the fullness of the box 216.

On the other hand, the photosensitive member unit 20 is further provided with a shutter 119, which is opened and closed as it is mounted on and demounted from the main body 100 of the image forming apparatus.

(Construction of Intermediate Transfer Unit 21)

Here will be described the construction of the intermediate transfer unit 21.

The transfer belt 5*a* is tensed to run on two rollers: the drive roller 240 held by the frame 245 including a grip portion 280; and a driven roller 241.

The roller 240 is rotatably held at its two ends by a lefthand bearing 201 (as referred to FIG. 4) and a righthand bearing 205 (as referred to FIG. 5). And, a predetermined driving force is transmitted from the main body 100 through a coupling 242 (as referred to FIG. 5) at the righthand end portion. Moreover, bearings 243 at the two ends of the driven roller 241 are provided with compression springs 244 to apply a predetermined tension to the transfer belt 5*a*.

At a position across the transfer belt 5*a* and against the photosensitive drum 1, there is disposed the primary transfer roller 5*j*. This primary transfer roller 5*j* rotates through bearings 246 at the two ends while being pushed onto the photosensitive drum 1 through the transfer belt 5*a* by a predetermined pressure of compression springs 247.

At least one bearing 246 is made of a conductive member. And, this bearing 246 applies a predetermined charging bias voltage to the primary transfer roller 5*j*. As a result, the toners on the surface of the photosensitive drum 1 are primarily transferred onto the transfer belt 5*a*.

At a position, as confronting the drive roller 240, of the transfer belt 5*a*, on the other hand, there is disposed the cleaning charge roller unit 223 for applying the reversed charge of that at the transfer time to the residual toners on the transfer belt 5*a*.

The roller 5*f* rotates through bearings 211 at the two ends while being pushed onto the drive roller 240 through the transfer belt 5*a* by a predetermined pressure of compression springs 212.

On the other hand, at least one bearing 211 is made of a conductive member, and applies the reversed voltage of that at the transfer time to the cleaning charge roller 5*f* and the reversed charge of that at the transfer time to the residual toners on the transfer belt 5*a*. As a result, the residual toners are electrostatically attracted and recovered on the drum surface by the photosensitive drum 1 and are accumulated in the box 216, as has been described hereinbefore.

(Unit Construction of Process Cartridge)

Figure 6:
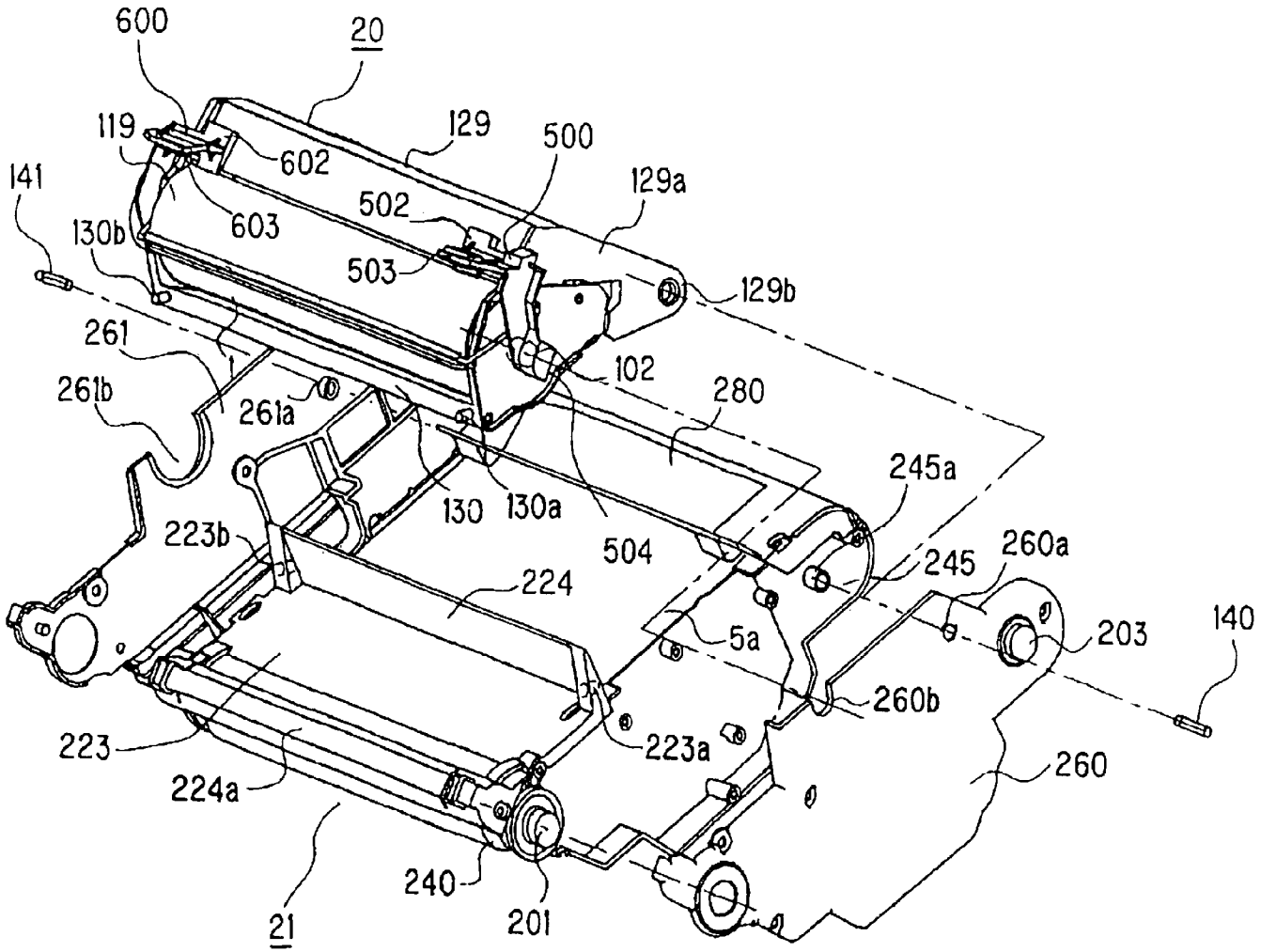
FIG. 6 is an exploded perspective view of the process cartridge according to this embodiment and taken from the lefthand side for explaining the construction of the process cartridge.
Figure 7:
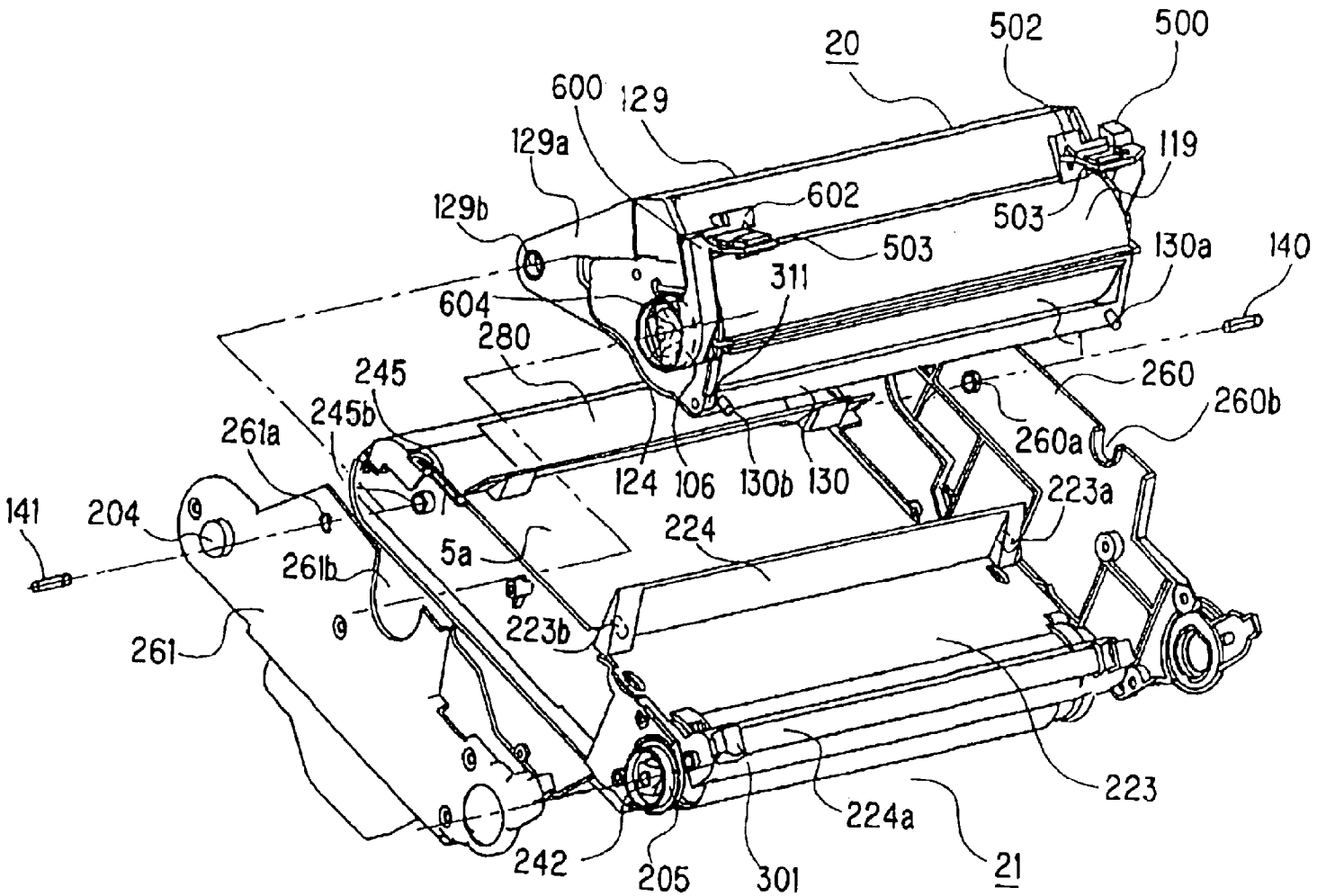
FIG. 7 is an exploded perspective view of the process cartridge according to this embodiment and taken from the righthand side for explaining the construction of the process cartridge.
Figure 8:
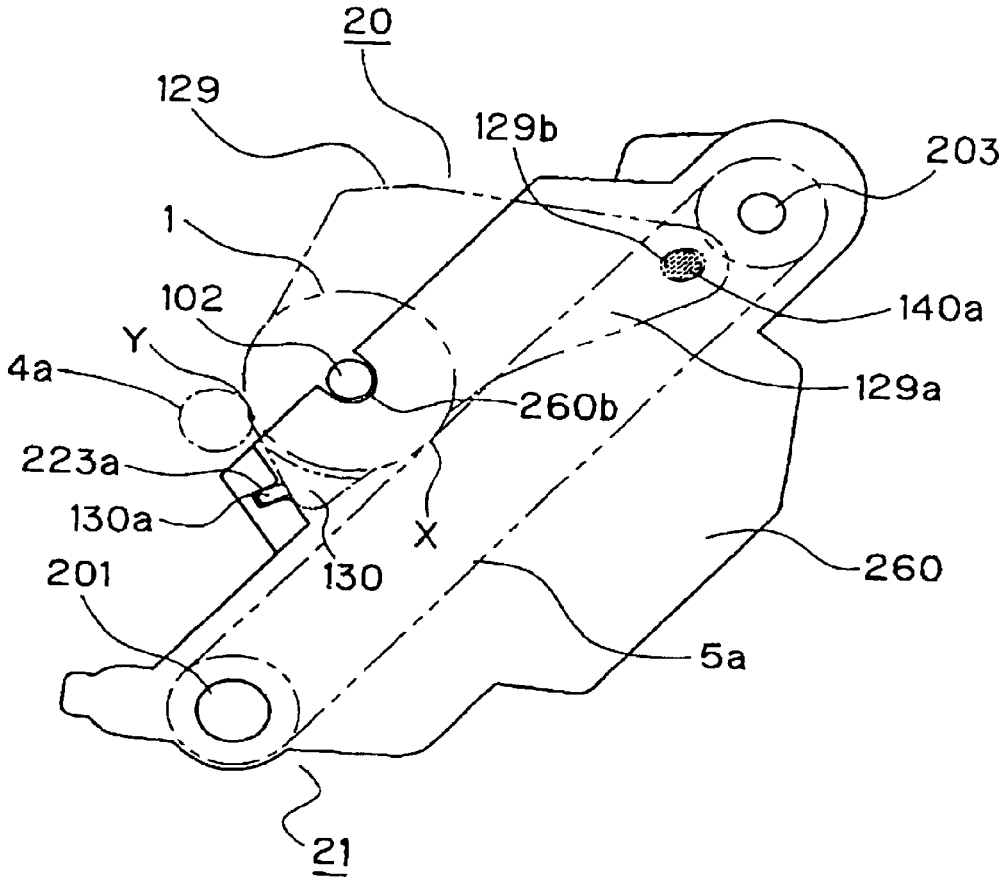
FIG. 8 is a schematic diagram of the process cartridge according to this embodiment and taken in the side face direction when the process cartridge is mounted in the apparatus body.

With reference to FIGS. 4 to 8, here will be described the process cartridge 5. FIG. 4 is a perspective view of the process cartridge according to this embodiment and taken from the lefthand side; FIG. 5 is a perspective view of the same and taken from the righthand side; FIG. 6 is an exploded perspective view taken from the lefthand side for explaining the construction of the process cartridge according to this embodiment; FIG. 7 is an exploded perspective view taken from the righthand side of the same; and FIG. 8 is a schematic diagram of the process cartridge according to this embodiment and taken in the side face direction when the process cartridge is mounted in the apparatus body.

The frame construction is coarsely divided into two units. First of all, the photosensitive member unit 20 (the first unit) is constructed to include major components: the photosensitive member frame 129; the photosensitive drum 1; the righthand bearing 106; the lefthand bearing 102; the charge roller (the process means) 2; the cleaning blade (the process means) 6; the conveyor screw 128; and the shutter member 119.

The photosensitive member frame 129 is provided on its frame side faces 129*a* with a plurality of engaging portions. The frame side faces 129*a* are provided in their backs with a plurality of holes 129*b* so that the photosensitive member frame 129 may be supported in a rocking manner by later-described metal pins 140 and 141.

In front of the frame side faces 129*a*, moreover, there are individually positioned and fixed the righthand bearing 106 and the lefthand bearing 102 for holding the photosensitive drum 1 rotatably.

As shown in FIG. 8, moreover, the frame side faces 129*a* are integrally jointed by a reinforcing joint portion 130 in the photosensitive drum circumferential direction between a transfer belt 5*a* abutting portion X and a developing roller abutting portion Y. With the two end portions of the joint portion 130, moreover, there are integrally constructed stopper pins 130*a* and 130*b*, which function to prevent the unit 20 from coming out when the unit 20 is assembled with the later-described unit 21.

The intermediate transfer unit 21 (the second unit) has the transfer belt 5*a* tensed in the frame 245 to run on the drive roller 240 and the drive roller 241. Moreover, the primary transfer roller 5*j* is arranged on the inner side of the transfer belt 5*a* confronting the photosensitive drum 1, and the cleaning charge roller 5*f* is arranged on the drive roller 240.

A righthand side cover 261 and a lefthand side cover 260 are fixed on the two sides of the frame 245 by means such as screws. From the outer side face of the cover 261, there are protruded the flange portion of the righthand bearing 205 of the drive roller 240 and a protrusion 204, which is formed integral with the cover 261. From the outer side face of the lefthand side cover 260, as in the righthand side cover 261, there are protruded the flange portion of the lefthand bearing 201 of the drive roller 240 and a protrusion 203, which is formed integral with the cover 260.

Here will be described how to assemble the process cartridge 5, which is constructed by integrating the first unit (the photosensitive member unit 20) and the second unit (the intermediate transfer unit 21).

The process cartridge 5 is assembled separately with the photosensitive member unit 20, in which the photosensitive drum 1 is rotatably supported, and the intermediate transfer unit 21 having the transfer belt 5*a*.

In the side covers 260 and 261 and the frame 245 of the unit 21, respectively, as shown in FIG. 6 and FIG. 7, there are formed holes 260*a* and 261*a*, and 245*a* and 245*b* for press-fitting and supporting the metal pins 140 and 141 coaxially. In the two end portions of a frame 224 of the cleaning charge roller unit 223, respectively, there are formed stopper holes 223*a* and 223*b* for preventing the aforementioned photosensitive member unit 20 from coming out when the unit 20 is mounted.

When the unit 20 is to be assembled with the unit 21, the stopper pins 130*a* and 130*b* disposed on the joint portion 130 of the frame 129 are inserted at first into the stopper holes 223*a* and 223*b* of the unit 21.

Next, the metal pins 140 and 141 are press-fitted into the holes 129*b* of the frame side faces 129*a* and into the holes 260*a* and 245*a*, and 261*a* and 245*b* of the lefthand and righthand side covers 260 and 261 and the intermediate transfer frame 245 while being axially aligned.

At this time, the stopper holes 223*a* and 223*b* of the unit 21 and the stopper pins 130*a* and 130*b* of the joint portion 130 are fitted through a predetermined clearance.

Moreover, the righthand bearing 106 and the lefthand bearing 102 holding the photosensitive drum 1 rotatably and positioned and fixed in engagement with the frame 129 are protruded to the outside through U-grooves 261*b* and 260*b*, which are formed in the righthand side cover 261 and the lefthand side cover 260, respectively.

The righthand and lefthand bearings 106 and 102 and the U-grooves 261*b* and 260*b* also keep individually predetermined clearances. Therefore, the unit 20 is so supported as to rock with respect to the unit 21 by the metal pins 140 and 141. Moreover, the holes 129*b* of the frame side face 129*a* are formed into a slot shape. As a result, the unit 20 and the unit 21 can move relative to each other.

When the aforementioned cartridge 5 is to be mounted in the image forming apparatus A, the photosensitive member unit 20 is positioned in the main body 100 of the apparatus A directly through the righthand bearing 106 and the lefthand bearing 102, as protruded from the righthand side cover 261 and the lefthand side cover 260, so that the photosensitive drum 1 is fixed.

On the other hand, the intermediate transfer unit 21 is positioned in the main body 100 directly through the flange portion of the righthand bearing 205 of the drive roller 240, the protrusion 204 of the righthand side cover 261, the lefthand bearing 201 of the drive roller 240 and the protrusion 203 of the lefthand side cover 260.

At this time, the unit 20 and the unit 21 are integrated into the cartridge. Therefore, the drive transmission coupling between the unit 20 and the unit 21 is displaced relative to each other by the parts allowances or the like. However, the unit 20 is so supported as to rock and move relative to the unit 21. Even if the drive transmission coupling is positioned in the main body 100 of the apparatus A independently of the unit 20 and the unit 21, therefore, the relative positional displacement due to the parts allowances or the like is absorbed.

At the same time, the two frame side faces 129*a* of the frame 129 of the unit 20 are integrally jointed and reinforced by the reinforcing joint portion 130. And, this joint portion 130 is given the function to prevent the unit 20 from coming out. Moreover, the unit 20 is so supported by the twin metal pins 140 and 141 press-fitted in the lefthand and righthand side covers 260 and 261 and the frame 245 as to rock with respect to the unit 21.

As a result, there is constructed the process cartridge 5, which is high in the supporting rigidity of the photosensitive drum 1 and in the joint rigidity of the unit 20 to the unit 21 and which is simple for the assembly.

(Spaced Construction of Photosensitive Drum and Charging Roller)

Figure 1:
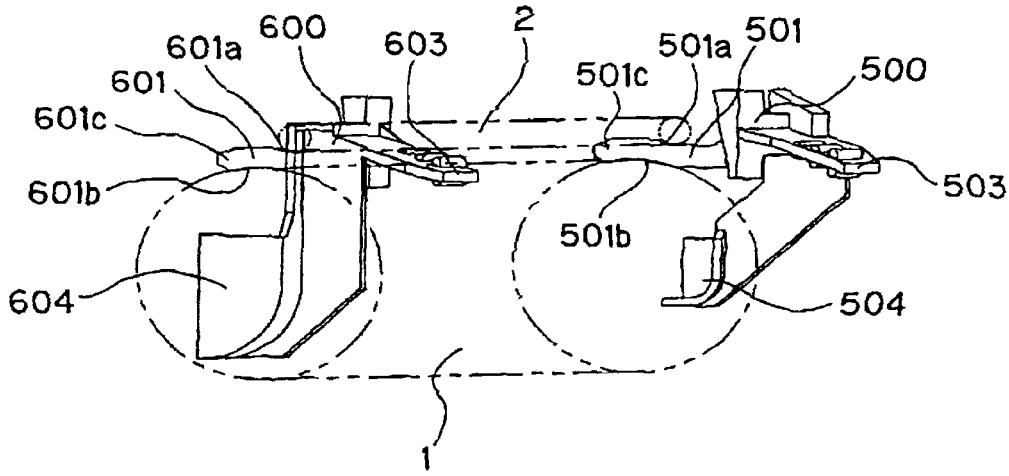
FIG. 1 is a perspective view of a spacing member according to a first embodiment.

With reference to FIG. 1, here will be specifically described the spacing construction using the spacing members of the photosensitive drum 1 and charging roller 2 according to one embodiment of the invention. FIG. 1 is a perspective view of the spacing member according to the first embodiment.

The charging roller 2 is biased to contact the photosensitive drum 1 through the bearings 125 at the two ends by a predetermined force of the compression springs 126, as has been described hereinbefore.

Before the cartridge 5 is mounted (but not used) in the main body 100 of the apparatus A, however, spacing members 500 and 600 are attached to the cartridge 5 so as to space the photosensitive drum 1 and the charging roller 2 at a predetermined clearance.

The spacing members 500 and 600 have spacing portions 501 and 601, which are inserted between the two end portions 2*a* and 2*b* of a charging roller shaft 2*c* and the surface of the photosensitive drum 1 thereby to space the photosensitive drum 1 and the charging roller 2.

As shown in FIG. 1, the spacing portions 501 and 601 are provided with: first recesses 501*a* and 601*a* adapted to be fitted on the two end portions 2*a* and 2*b* of the charging roller shaft 2*c*; and second recesses 501*b* and 601*b* curved arcuately along the circumference of the photosensitive drum 1 and adapted to be fitted on the surface of the photosensitive drum 1.

And, the spacing portions 501 and 601 are inserted into such positions as to fit the two end portions 2*a* and 2*b* of the charging roller shaft 2*c* and the first recesses 501*a* and 601*a*, and the surface of the photosensitive drum 1 and the second recesses 501*b* and 601*b*, respectively. As a result, the photosensitive drum 1 and the charging roller 2 are spaced through the predetermined clearance.

Moreover, leading end portions 501*c* and 601*c* in the inserting direction are made wider than the width between the surface of the photosensitive drum 1 and the two end portions 2*a* and 2*b* of the charging roller shaft 2*c*. As a result, the spacing members 500 and 600 are prevented from easily coming out when vibrations or impacts are applied to the cartridge 5 at the physical distribution time or the like. When the operator extracts the spacing members 500 and 600, moreover, the charging roller 2 is pushed onto the photosensitive drum 1 by the spring force. In this state, therefore, the surface of the photosensitive drum 1 can be charged.

Moreover, the spacing members 500 and 600 are provided with stopper portions 502 and 602 on the back of the direction (i.e., the direction of arrow S (as referred to FIG. 3)) for the spacing members 500 and 600 to be inserted into the cartridge 5. These stopper portions 502 and 602 are provided for preventing the shutter member 119 from being opened when the cartridge 5 is not mounted in the main body 100.

The stopper portions 502 and 602 are formed into such a flange shape as to clog not-shown insertion holes, which are formed in the photosensitive member frame 129 to insert the spacing members 500 and 600 into the cartridge 5, and as to cover a portion of the shutter member 119.

When the cartridge 5 is not mounted in the main body 100, therefore, any light is prevented from entering from the clearance of the insertion hole. And the shutter member 119 interferes, even if it is to be opened, with the stopper portions 502 and 602 of the spacing members 500 and 600. Therefore, the shutter member 119 is held at the closed position.

Therefore, the photosensitive drum 2 always has its exposure portion covered with the shutter member 119. As a result, it is possible to prevent the photosensitive layer from being degraded by the light and the photosensitive drum 1 from being damaged in its surface.

Here, the aforementioned insertion hole is formed in a direction generally perpendicular to the opening/closing direction (the direction of arrow Q) of the shutter member 119. Therefore, the directions for the spacing members 500 and 600 to be inserted into and extracted from the cartridge 5 are generally perpendicular to the opening and closing directions of the shutter member 119. As a result, no force is applied in the direction to extract the spacing members 500 and 600 when the shutter member 119 is to be opened.

On the back of the insertion direction of the stopper portions 502 and 602, moreover, there are provided grip portions 503 and 603 for the operator to remove the spacing portions 500 and 600 from the cartridge 5 when the cartridge 5 is to be mounted in the main body 100 of the image forming apparatus A.

Moreover, the spacing members 500 and 600 are provided with protective portions 504 and 604. By these protective portions 504 and 604, the cartridge 5 is prevented from being mounted in the main body 100 while the spacing members 500 and 600 are attached to the cartridge 5.

The protective portions 504 and 604 are formed into a half-moon shape. As a result, the protective portions 504 and 604 cover the righthand bearing 106 and the lefthand bearing 102 of the photosensitive member unit 20, i.e., the mounting and positioning portions of the cartridge 5 in the main body 100, from the side of the direction to insert the cartridge 5 into the apparatus body 100.

When the cartridge 5 is to be mounted in the main body 100 without detaching the spacing members 500 and 600, the aforementioned protective portions 504 and 604 interfere with not-shown guide portion of the apparatus body 100. Therefore, the cartridge 5 cannot be mounted in the main body 100 of the apparatus A.

When the operator mounts the cartridge 5 in the apparatus body 100, therefore, the operator is required to remove the spacing members 500 and 600. As a result, it is possible to prevent the operator reliably from forgetting to remove the spacing members 500 and 600 from the cartridge 5. When the cartridge 5 is to be mounted in the main body 100, moreover, the photosensitive drum 1 and the charging roller 2 can be reliably released from their spaced relation.

Here in this embodiment, the protective portions 504 and 604 interfere with the guide portion of the main body 100 thereby to ensure that spacing release. Without the protective portions 504 and 604, however, the directions for the spacing members 500 and 600 to be inserted into and extracted from the cartridge 5 are generally perpendicular to the opening and closing directions of the shutter member 119. Even when the cartridge 5 is to be mounted in the main body 100 without detaching the spacing members 500 and 600, therefore, the shutter member 119 is held at the closed position so that the cartridge 5 cannot be mounted in main body 100. As a result, the operator is required to remove the spacing members 500 and 600 from the cartridge 5 so that a similar effect can also be exhibited for preventing the operator from forgetting to remove the spacing members 500 and 600.

With the construction thus far described, while the cartridge 5 is being unused, the photosensitive drum 1 and the charging roller 2 are held in the spaced state. Therefore, it is possible to prevent the defects of images such as the horizontal unevenness of charge, which are caused due to the deformation of the charging roller 2 when the cartridge 5 is stored without any action for a long time, or the image inconsistencies, which are caused by the sliding variations between the photosensitive drum 1 and the charging roller 2 due to the vibrations at the physical distribution time or the like.

While the cartridge 5 is not mounted in the apparatus body 100, moreover, the shutter member 119 is prevented from being opened. In addition, the cartridge 5 cannot be mounted in the main body 100 without detaching the spacing members 500 and 600, so that these spacing members 500 and 600 can be reliably prevented from being forgotten to be removed from the cartridge 5.

Here, this embodiment has been described for the example, in which the paired spacing members are used for ensuring the spacing more reliably. However, the construction may be modified by using only one spacing member, so long as it can space the photosensitive drum 1 and the charging roller 2.

(Second Embodiment)

Figure 9:
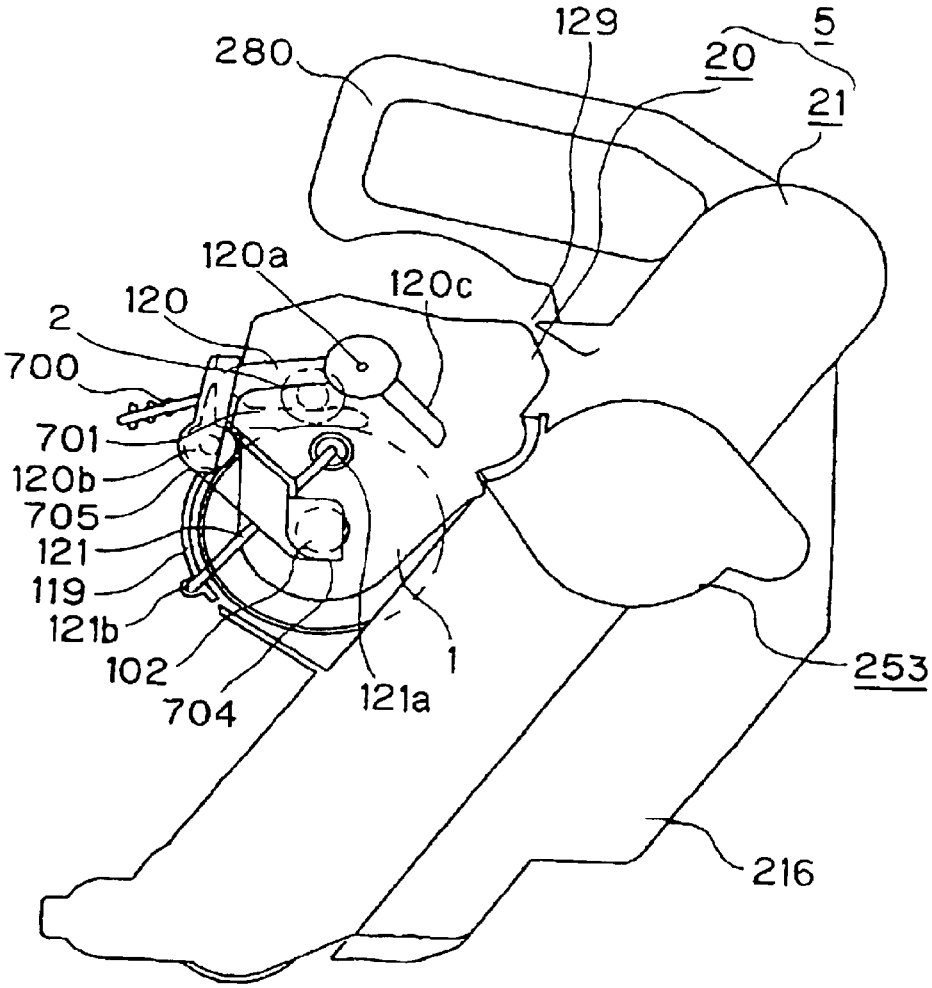
FIG. 9 is a section of a process cartridge according to a second embodiment.
Figure 10:
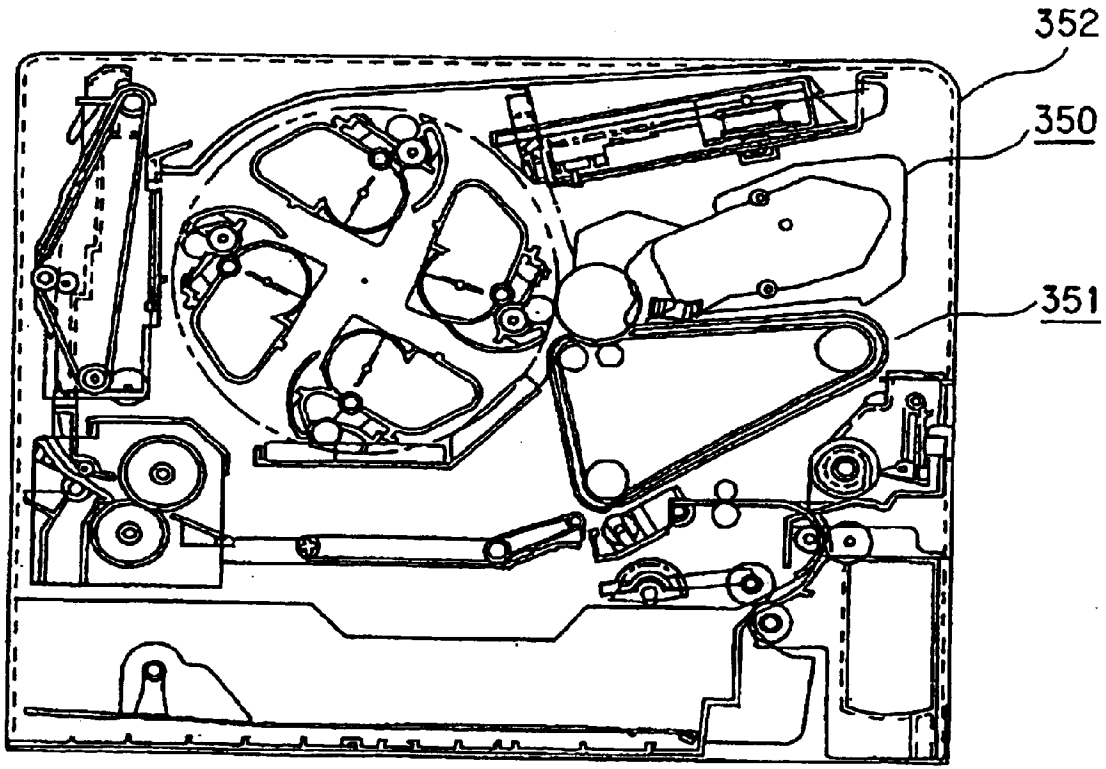
FIG. 10 is a longitudinal section of an image forming apparatus for electronic photography of the prior art.

With reference to FIG. 9, here will be described a second embodiment of the invention. FIG. 9 is a section of a process cartridge according to the second embodiment.

The foregoing first embodiment is constructed such that, while the cartridge 5 is unused, the photosensitive drum 1 and the charging roller 2 are held in the spaced state, and such that the shutter member 119 interferes with the stopper portions 502 and 602 so that it cannot do the opening actions. When the spacing members 500 and 600 are attached to the cartridge 5, moreover, the cartridge 5 cannot be mounted, even if intended so, in the main body 100, because the protective portions 504 and 604 interfere with the guide portion of the main body 100.

Moreover, the second embodiment is constructed by integrating arm protecting portions 705 with spacing members 700. Each of these protecting portions 705 covers an arm portion 120 for opening the shutter member 119 in response to the mounting action to mount the cartridge 5 in the main body 100. Therefore, the shutter member 119 can be prevented from being opened, when the cartridge 5 is mounted with the spacing member 700 in the main body 100 of the apparatus A.

With reference to FIG. 9, here will be described the constructions of the shutter member 119 and the arm portion 120 for opening the shutter member 119 in response to the mounting action of the cartridge 5 in the main body 100.

The shutter member 119 is rotatably jointed to the arm portion 120 by a joint portion 120*b*.

On the other hand, the arm portion 120 is rotatably jointed to a shaft 120*a*, which is mounted on the side face of the photosensitive member frame 129. Moreover, the arm portion 120 has a protrusion 120*c* extending radially from the shaft 120*a*.

The straight line joining the pin 120*a* and the joint portion 120*b* and the protrusion 120*c* make an angle of about 100 degrees.

On the other hand, the shutter member 119 is rotatably jointed to a shutter shaft 121, at a position 121*b* apart from the joint portion 120*b* to the aforementioned arm portion 120. Moreover, the shutter shaft 121 is irrotationally jointed at a joint portion 121*a* to the cartridge 5. And, the arm portion 120 is always biased in the direction to close the shutter member 119 by a not-shown torsion spring.

At the time of mounting the cartridge 5 in the main body 100, the shutter member 119 starts its opening action, as the joint portion 120*b* to the shutter member 119 comes into abutment against the not-shown first abutting portion provided on the body guide. As the cartridge 5 is further pushed down, the aforementioned protrusion 120*c* begins to abut against the not-shown second abutting portion provided on the aforementioned body guide. As a result, the shutter member 119 continues its opening action. And, this opening action of the shutter member 119 is completed when the cartridge 5 is completely mounted in the main body 100.

Here, the cartridge 5 with the spacing member 700 of the second embodiment is mounted in the main body 100. At the joint portion 120*b*, the protecting portion 705 then interferes with the first abutting portion of the apparatus body 100. Therefore, the shutter member 119 cannot start its opening action. In the construction thus far described, the protecting portion 705 interferes with the first abutting portion so that the spacing member 700 can be reliably prevented from being forgotten to be removed. In addition, the arm portion 120 is not brought into abutment against the first abutting portion by the protecting portion 705. Therefore, the arm portion 120 is not broken, even if the cartridge 5 with the spacing member 700 is to be erroneously mounted in the main body 100.

Here, this embodiment has been described on the example, in which the paired spacing members are used for ensuring the spacing more reliably. However, the construction may be modified by using only one spacing member, so long as it can space the photosensitive drum and the charging roller.

According to this embodiment thus far described, while the cartridge 5 is being unused, the photosensitive drum 1 and the charging roller 2 are spaced from each other. Therefore, it is possible to eliminate the horizontal unevenness of charge, which might otherwise be caused due to the deformation of the charging roller 2 when the cartridge 5 is stored without any action for a long time, or image inconsistencies, which are caused by the sliding variations between the photosensitive drum 1 and the charging roller 2 due to the vibrations at the physical distribution time or the like.

While the cartridge 5 is not mounted in the main body 100, moreover, the shutter member 119 interferes with the stopper portions 502 and 602 of the spacing members 500 and 600 thereby to hold its closed position. As a result, the photosensitive drum 1 always has its exposure portion covered with the shutter member 119. Therefore, it is possible to prevent the degradation of the photosensitive layer due to the light and the damage on the photosensitive drum surface.

With the spacing members 500 and 600 being attached to the cartridge 5, moreover, the protective portions 504 and 604 of the spacing members 500 and 600 interfere with the guide portion of the main body 100 when the cartridge 5 is to be mounted in the main body 100. This makes it necessary to remove the spacing members 500 and 600. Therefore, it is possible to reliably prevent the operator from forgetting to remove the spacing members 500 and 600 from the cartridge 5. In other words, the spacing between the photosensitive drum 1 and the charging roller 2 can be reliably released when the cartridge 5 is to be mounted in the main body 100.

According to the invention, as has been described hereinbefore, it is possible to keep the spaced state between the electrophotographic photosensitive drum and the charging roller reliably.

While the invention has been described with reference to the structure disclosed herein, it is not confined to the details set forth and this application is intended to cover such modifications or changes as may come within the purpose of the improvements or the scope of the following claims.

What is claimed is:

1. A spacing member to be attached to a process cartridge, which includes: a photosensitive drum; a charging roller adapted to contact the photosensitive drum positioned and configured to charge the photosensitive drum; and a shutter member configured and positioned to cover an exposure portion, where the photosensitive drum is exposed from a cartridge frame, and which can be mounted in and demounted from a main body of an electrophotographic image forming apparatus, said spacing member comprising:

a spacing portion configured and positioned to space the photosensitive drum and the charging roller apart when said spacing member is attached to the process cartridge;

a stopper portion configured and positioned to prevent the shutter member from retracting from a protection position for covering the exposure portion, when said spacing member is attached to the process cartridge; and a protective portion configured and positioned to cover a positioning portion, which positions the process cartridge in the main body of the electrophotographic image forming apparatus when the process cartridge is mounted in the main body of the electrophotographic image forming apparatus, when said spacing member is attached to the process cartridge.

2. A spacing member according to claim 1, further comprising a grip portion configured and positioned for an operator to remove said spacing member from the process cartridge, wherein said grip portion is arranged on an upstream side of said spacing member in an insertion direction in which said stopper portion is inserted into the process cartridge, when said spacing member is to be attached to the process cartridge.

3. A spacing member according to claim 1 or 2, wherein said protective portion comes into contact with the main body of the electrophotographic image forming apparatus to prevent the process cartridge from being mounted in the main body of the electrophotographic image forming apparatus, when the process cartridge is to be mounted in the main body of the electrophotographic image forming apparatus without detaching said spacing member.

4. A spacing member according to claim 3, wherein said protective portion covers righthand and lefthand bearings of the process cartridge which comprise the positioning portion, which positions the process cartridge in the main body of the electrophotographic image forming apparatus when the process cartridge is mounted in the main body of the electrophotographic image forming apparatus.

5. A spacing member according to claim 4, wherein said protective portion has a half-moon shape.

6. A spacing member according to claim 1 or 2, wherein the directions in which said spacing member is to be attached to and detached from the process cartridge are generally perpendicular to the moving direction of the shutter member.

7. A process cartridge detachably mountable to a main body of an electrophotographic image forming apparatus, comprising:

(i) a photosensitive drum;

(ii) a charging roller adapted to contact with said photosensitive drum to charge said photosensitive drum;

(iii) a shutter member configured and positioned to cover an exposure portion, where said photosensitive drum is exposed from a cartridge frame; and (iv) a spacing member, wherein said spacing member includes:

a spacing portion configured and positioned to space said photosensitive drum and said charging roller apart;

a stopper portion configured and positioned to prevent said shutter member from retracting from a protection position for covering the exposure portion; and a protective portion configured and positioned to cover a positioning portion, which positions said process cartridge in a main body of the electrophotographic image forming apparatus when said process cartridge is mounted in the main body of the electrophotographic image forming apparatus.

8. A process cartridge according to claim 7, wherein said spacing member further includes a grip portion for an operator to remove said spacing member from said process cartridge, wherein said grip portion is arranged on upstream side of said spacing member in an insertion direction, in which said stopper portion is inserted into said process cartridge, when said spacing member is to be attached to said process cartridge.

9. A process cartridge according to claim 7 or 8, wherein said protective portion comes into contact with the main body to prevent said process cartridge from being mounted in the main body, when said process cartridge is to be mounted in main body without detaching said spacing member.

10. A process cartridge according to claim 9, wherein said protective portion covers righthand and lefthand bearings of said process cartridge which comprise the positioning portion, which positions said process cartridge in the main body of the electrophotographic image forming apparatus when said process cartridge is mounted in the main body of the electrophotographic image forming apparatus.

11. A process cartridge according to claim 10, wherein said protective portion has a half-moon shape.

12. A process cartridge according to claim 7 or 8, wherein the directions in which said spacing member is to be attached to and detached from said process cartridge are generally perpendicular to the moving direction of said shutter member.

13. An electrophotographic image forming apparatus to which a process cartridge is detachably mountable to a main body of said electrophotographic image forming apparatus, said electrophotographic image forming apparatus comprising:

(i) a mounting portion configured and positioned to removably mount the process cartridge including a photosensitive drum, a charging roller adapted to contact the photosensitive drum and configured and positioned to charge the photosensitive drum, and a shutter member configured and positioned to cover an exposure portion, where the photosensitive drum is exposed from a cartridge frame; and (ii) a preventing portion configured and positioned to contact a spacing member to prevent the process cartridge from being mounted in said mounting portion without detaching the spacing member; wherein the spacing member includes a a spacing portion configured and positioned to space the photosensitive drum and the charging roller apart, a stopper portion configured and positioned to prevent the shutter member from retracting from a protection position for covering the exposure portion, and a protective portion for covering a positioning portion, which positions the process cartridge in the main body of said electrophotographic image forming apparatus when the process cartridge is mounted in the main body of said electrophotographic image forming apparatus.

* * * * *